US010264935B2

(12) United States Patent
Kim et al.

(10) Patent No.: US 10,264,935 B2
(45) Date of Patent: Apr. 23, 2019

(54) AUTOMATIC CLEANER

(71) Applicant: LG ELECTRONICS INC., Seoul (KR)

(72) Inventors: Yiebin Kim, Seoul (KR); Jeongsuk Yoon, Seoul (KR); Seungmin Baek, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 367 days.

(21) Appl. No.: 14/917,247

(22) PCT Filed: Sep. 12, 2013

(86) PCT No.: PCT/KR2013/008267
§ 371 (c)(1),
(2) Date: Mar. 7, 2016

(87) PCT Pub. No.: WO2015/037755
PCT Pub. Date: Mar. 19, 2015

(65) Prior Publication Data

US 2016/0206165 A1 Jul. 21, 2016

(51) Int. Cl.

| | |
|---|---|
| ***A47L 9/04*** | (2006.01) |
| ***A47L 9/06*** | (2006.01) |
| *A47L 11/24* | (2006.01) |

(52) U.S. Cl.
CPC ..... *A47L 9/0488* (2013.01); *A47L 9/0405* (2013.01); *A47L 9/0444* (2013.01); *A47L 9/0666* (2013.01); *A47L 11/24* (2013.01); *A47L 2201/00* (2013.01)

(58) Field of Classification Search
CPC .... A47L 9/0488; A47L 9/0666; A47L 9/0444; A47L 9/0455; A47L 9/0472; A47L 2201/00; A47L 9/0405; E01H 1/053
(Continued)

(56) References Cited

U.S. PATENT DOCUMENTS 5,249,332 A * 10/1993 Wilkerson ..... E01H 1/042 15/340.4
7,610,651 B2 11/2009 Baek
(Continued)

FOREIGN PATENT DOCUMENTS

| | | |
|---|---|---|
| EP | 2 578 125 | 4/2013 |
| EP | 2 583 605 | 4/2013 |

(Continued)

OTHER PUBLICATIONS

European Search Report dated May 18, 2017 issued in Application No. 13893476.5.

(Continued)

*Primary Examiner* — Bryan R Muller
(74) *Attorney, Agent, or Firm* — Ked & Associates LLP

(57) ABSTRACT

The present specification relates to an automatic cleaner. The automatic cleaner, according to one aspect, comprises: a casing having an inlet port; a suction device which is installed inside the casing and sucks external foreign substances through the inlet port; a moving device for moving the casing; and a side brush assembly movably installed at the casing, wherein the side brush assembly comprises: a movable member which is provided so as to be movable in the casing and protrudes outside of the casing; a side brush provided so as to be rotatable at the movable member; a hinge shaft for enabling the rotation of the movable member; and an elastic member for supporting the hinge shaft or the movable member.

17 Claims, 7 Drawing Sheets

(58) Field of Classification Search
USPC ..... 15/385, 392, 389, 371
See application file for complete search history.

(56) References Cited

U.S. PATENT DOCUMENTS

| | | | | |
|---|---|---|---|---|
| 9,045,872 | B2 * | 6/2015 | Wahl | E01H 1/02 |
| 9,078,552 | B2 * | 7/2015 | Han | A47L 9/00 |
| 2006/0236491 | A1 | 10/2006 | Baek | |
| 2013/0086760 | A1 | 4/2013 | Han et al. | |
| 2013/0291331 | A1 | 11/2013 | Yang et al. | |
| 2015/0265122 | A1 | 9/2015 | Han et al. | |

FOREIGN PATENT DOCUMENTS

| | | | | | |
|---|---|---|---|---|---|
| JP | S 62-292124 | | | 12/1987 | |
| JP | H 06-003258 | U | | 1/1994 | |
| JP | H063258 | U | * | 1/1994 | A47L 11/40 |
| JP | 2006-043302 | | | 2/2006 | |
| JP | 2011-045694 | A | | 3/2011 | |
| KR | 20-1993-0023007 | U | | 11/1993 | |
| KR | 2019930023007 | | * | 11/1993 | A47L 9/04 |
| KR | 10-2006-0111788 | A | | 10/2006 | |
| KR | 10-2007-0105124 | A | | 10/2007 | |
| KR | 10-2013-0032489 | A | | 4/2013 | |
| KR | 10-2013-0037448 | A | | 4/2013 | |

OTHER PUBLICATIONS

International Search Report dated Jun. 13, 2014 issued in Application No. PCT/KR2013/008267.

* cited by examiner

AUTOMATIC CLEANER

CROSS-REFERENCE TO RELATED PATENT APPLICATIONS

This application is a U.S. National Stage Application under 35 U.S.C. § 371 of PCT Application No. PCT/KR2013/008267, filed Sep. 12, 2013, whose entire disclosure is hereby incorporated by reference.

TECHNICAL FIELD

The present invention relates to an automatic cleaner.

BACKGROUND ART

Generally, a cleaner is a home appliance which suctions and removes foreign substances on a floor surface. Recently, among such cleaners, a cleaner which automatically performs a cleaning operation is referred to as an automatic cleaner. The automatic cleaner suctions and removes the foreign substances or the like on the floor surface while moving by driving force of a motor operated by a battery.

In Korean Patent Publication No. 2007-0105124 as a prior art document, there is disclosed an automatic cleaner with a side brush.

However, the automatic cleaner according to the prior art has the following problems.

In the case of the automatic cleaner according to the prior art, foreign substances located at an area corresponding to an outside of an inlet port are suctioned through the inlet port by rotation of the side brush. Therefore, as a length of the side brush is increased, an area which is cleaned by the automatic cleaner is substantially increased. However, when the length of the side brush is increased, it is apprehended that the side brush may be damaged while the automatic cleaner performs the cleaning operation or is kept. Also, when the length of the side brush is increased, an area which is occupied by the automatic cleaner is increased, and thus it is inconvenient to keep the automatic cleaner.

DISCLOSURE

Technical Problem

The present invention is directed to providing an automatic cleaner which is able to effectively clean every corner.

Also, the present invention is directed to providing an automatic cleaner which is able to reduce damage of a side brush assembly.

Technical Solution

One aspect of the present invention provides an automatic cleaner including a casing having an inlet port; a suction device installed inside the casing and configured to suction external foreign substances through the inlet port; a moving device configured to move the casing; and a side brush assembly movably installed at the casing, wherein the side brush assembly includes a movable member which is movably provided at the casing and protrudes outside of the casing, a side brush which is rotatably installed at the movable member, and an elastic member which supports the movable member so as to enable the movable member to protrude outside of the casing.

The movable member may include a second movable member which is movably connected to the casing, and a first movable member which is rotatably connected to the second movable member through a hinge shaft, and the side brush may be installed at the first movable member.

A driving device which drives the side brush may be provided at the first movable member, and the driving device may be rotated together with the first movable member.

The driving device may include a brush driving unit, and a power transmission unit which transmits power of the brush driving unit to the side brush.

The elastic member may elastically support the hinge shaft or the first movable member.

The automatic cleaner may further include an elastic member which elastically supports the second movable member.

The second movable member may include a rotation restricting part which restricts a rotation angle range of the first movable member.

The casing may include a rotation restricting part which restricts a rotation angle range of the first movable member.

Another aspect of the present invention provides an automatic cleaner including a casing having an inlet port; a suction device installed inside the casing and configured to suction external foreign substances through the inlet port; a moving device configured to move the casing; and a side brush assembly movably installed at the casing, wherein the side brush assembly includes a movable member which is movably provided at the casing and protrudes outside of the casing, a side brush which is rotatably installed at the movable member, and a hinge shaft which enables the movable member to be rotated with respect to the casing.

An opening through which the movable member passes may be formed at the casing, and a shock absorbing member which absorbs a shock generated by a collision with the movable member may be provided at the opening.

A driving device which drives the side brush may be provided at the movable member, and the driving device may be rotated together with the movable member.

A shaft guide part which enables the hinge shaft to be moved horizontally may be formed at the casing.

One or more elastic members which elastically support the hinge shaft may be provided at the shaft guide part.

Still another aspect of the present invention provides an automatic cleaner including a casing having an inlet port; a suction device installed inside the casing and configured to suction external foreign substances through the inlet port; a moving device configured to move the casing; and a side brush assembly movably installed at the casing, wherein the side brush assembly includes a movable member which is movably provided at the casing and protrudes outside of the casing, and a side brush which is rotatably installed at the movable member, and at least a part of the movable member is formed of a flexible material which is able to be deformed by an external force.

The movable member may include a fixed member which is fixed to the casing, a supporting member which supports the side brush, and a connection member which is formed of a flexible material and connects the fixed member with the supporting member.

The automatic cleaner may further include a driving device which has a brush driving unit for driving the side brush, and the brush driving unit may be provided at one of the supporting member, the fixed member and the casing.

The movable member may include a supporting member which supports the side brush, and a connection member which is formed of a flexible material, connected to the supporting member and also connected to the casing.

The automatic cleaner may include a driving device which has a brush driving unit for driving the side brush, and the brush driving unit may be provided at one of the supporting member and the casing.

Yet another aspect of the present invention provides an automatic cleaner including a casing having an inlet port; a suction device installed inside the casing and configured to suction external foreign substances through the inlet port; a moving device configured to move the casing; and a side brush assembly movably installed at the casing, wherein the side brush assembly includes a movable member which is movably provided at the casing and protrudes outside of the casing, a side brush which is rotatably installed at the movable member, and a driving device which has a brush driving unit for rotating the side brush, and the movable member includes a plurality of links which are relatively rotatable with respect to each other.

The side brush may be rotatably installed at an outmost link among the plurality of links, and the brush driving unit may be disposed at the outmost link.

The side brush may be rotatably installed at an outmost link among the plurality of links, and the driving device may include a power transmission unit which transmits power of the brush driving unit to the side brush, and the brush driving unit may be provided at the casing.

Advantageous Effects

According to the proposed embodiment, since the side brush assembly protrudes from the casing, a corner cleaning operation can be effectively performed.

Also, since the side brush assembly is movable by an external force, damage of the side brush assembly can be minimized.

MODES OF THE INVENTION

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustrating specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
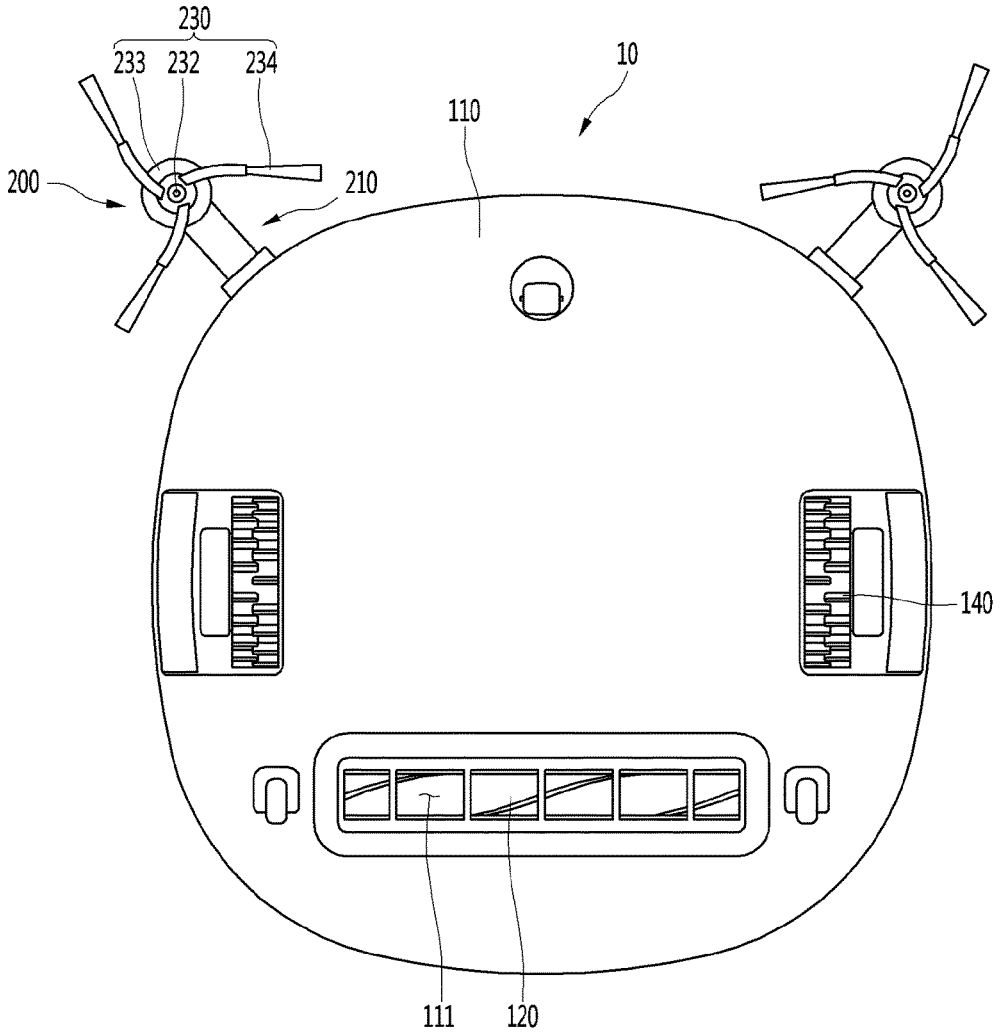
FIG. 1 is a bottom view of an automatic cleaner according to a first embodiment of the present invention.
Figure 2:
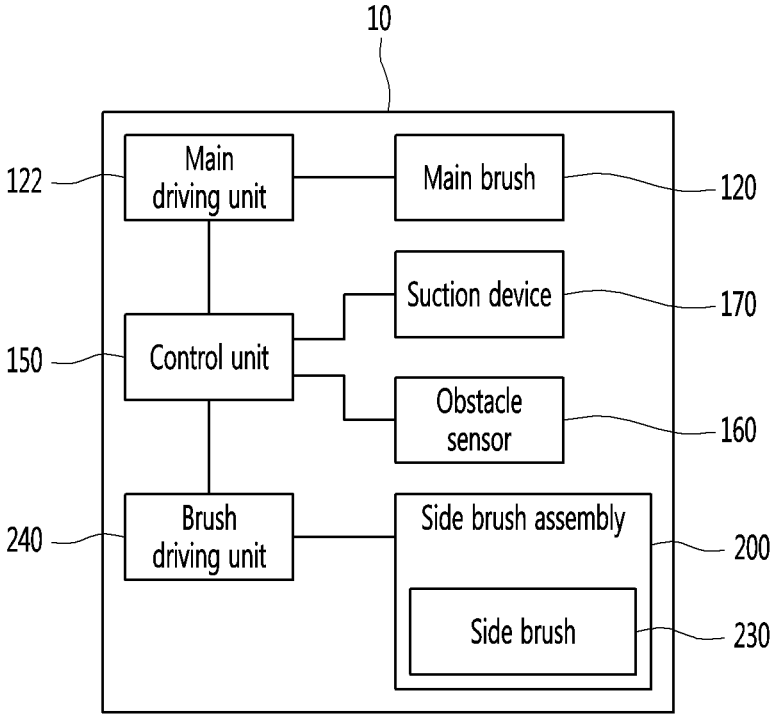
FIG. 2 is a block diagram of the automatic cleaner according to the first embodiment of the present invention.
Figure 3:
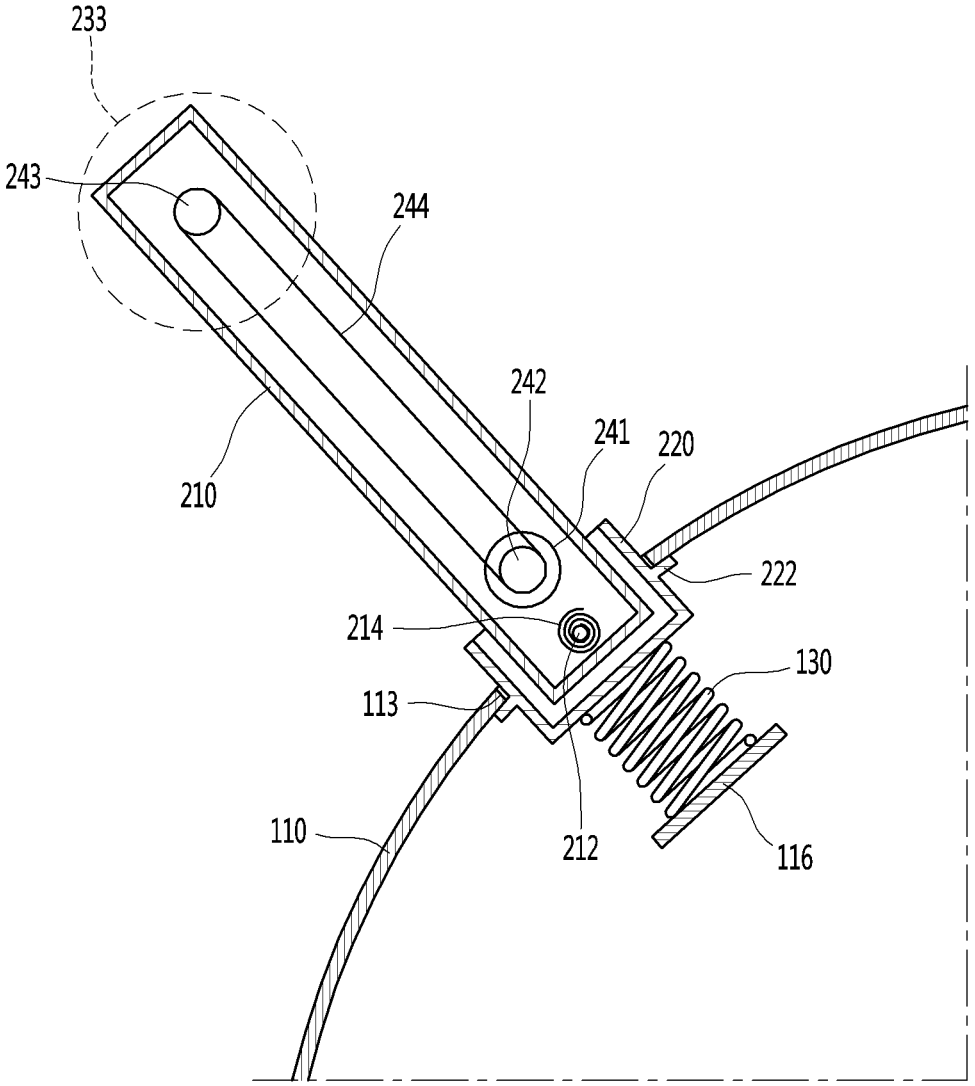
FIG. 3 is a cross-sectional view of a side brush assembly according to the first embodiment of the present invention.

FIG. 1 is a bottom view of an automatic cleaner according to a first embodiment of the present invention, FIG. 2 is a block diagram of the automatic cleaner according to the first embodiment of the present invention, and FIG. 3 is a cross-sectional view of a side brush assembly according to the first embodiment of the present invention.

Referring to FIGS. 1 to 3, an automatic cleaner 10 according to a first embodiment includes a casing 110 which forms an exterior. The casing 110 may be formed in a flat polyhedral shape or a circular shape, but the shape of the casing 110 is not limited thereto.

Various elements forming the automatic cleaner 10 may be installed inside the casing 110. For example, a suction device 170 which suctions foreign substances and a dust collecting device (not shown) in which the suctioned foreign substances are collected may be provided inside the casing 110.

An inlet port 111 is formed at a lower surface of the casing 110. The inlet port 111 serves as an entrance through which the foreign substances are suctioned into an inside of the casing 110, substantially, the dust collecting device. The inlet port 111 may be formed by cutting a part of the lower surface of the casing 110.

A main brush 120 may be installed at a position inside the casing 110 corresponding to the inlet port 111. The main brush 120 serves to pass through the inlet port 111, to be in contact with the foreign substances on a floor surface, and then to remove the foreign substances. The main brush 120 may be rotatably installed at the casing 110. And a main driving unit 122 provides a driving force for rotation of the main brush 120.

Also, a moving device 140 for movement of the casing 110 may be provided at the casing 110. The moving device 140 may include a driving motor (not shown) which is installed inside the casing 110, and a wheel 140 which is rotated by the driving motor. At this point, the moving device 140 may include one pair of wheels 140, and one pair of driving motors. Therefore, each of the wheels 140 may be independently rotated.

One or more side brush assemblies 200 are installed at a lower side of the casing 110. The embodiment will describe an example in which a plurality of side brush assemblies 200 are installed at the casing 110.

The side brush assemblies 200 may be installed to be movable at the casing 110. The side brush assemblies 200 may be located at the lower side of the casing 110. Alternatively, at least a part of the side brush assemblies 200 may be located inside the casing 110, and the other part thereof may be located outside the casing 110.

The side brush assembly 200 serves to enable the suction device 170 to suction the foreign substances located at an area corresponding to an outside of the inlet port 111 through the inlet port 111.

The side brush assembly 200 may include movable members 210 and 220 to which the casing 110 is movably connected, and a side brush 230 which is rotatably connected to the movable members 210 and 220 through a rotating shaft 232.

A part of the movable members 210 and 220 may be located inside the casing 110, and the other part thereof may be located outside the casing 110.

Therefore, since a part of the movable members 210 and 220 protrudes to an outside of the casing 110, there is an advantage that a cleanable area of the side brush 230 expands.

The side brush 230 may include a brush holder 233, and a plurality of hairs 234 which are provided at the brush holder 233.

The movable members 210 and 220 may include a second movable member 220 which is slidably disposed at the casing 110, and a first movable member 210 which is rotatably installed by a hinge shaft 212 of the second movable member 220.

An opening 113 through which the movable members 210 and 220 protrude may be formed at a side surface or the lower surface of the casing 110. A part of the second movable member 220 may protrude to an outside of the casing 110 through the opening 113.

An elastic member 130 which elastically supports the second movable member 220 may be provided at the casing 110. One end of the elastic member 130 may be fixed to an elastic member supporter 116 provided inside the casing 110, and the other end thereof may be fixed to the second movable member 220.

The elastic member 130 provides an elastic force to the second movable member 220 so that the second movable member 220 protrudes to the outside of the casing 110 through the opening 113.

A stopper 222 which restricts a protruding length of the second movable member 220 to the outside of the casing 110 is provided at the second movable member 220. Therefore, when an external force is applied to the second movable member 220, a part of the second movable member 220 which protrudes to the outside of the casing 110 may be inserted into the casing 110 by the elastic member 130, and the elastic member 130 may be contracted.

A part of the first movable member 210 may be accommodated in the second movable member 220, and the part of the first movable member 210 accommodated in the second movable member 220 is rotatably connected to the second movable member 220 by the hinge shaft 212. An elastic member 214 may be provided between the first movable member 210 and the second movable member 220. One end of the elastic member 214 may be supported by the second movable member 220, and the other end thereof may be supported by the first movable member 210. As long as the hinge shaft 212 is rotated together with the first movable member 210, the other end of the elastic member 214 may be connected to the hinge shaft 212. For example, the elastic member 214 may be a torsion spring, but is not limited thereto. The elastic member 214 may be a coil spring or a leaf spring.

As long as the external force is not applied to the first movable member 210 while the first movable member 210 is connected to the second movable member 220, the first movable member 210 is maintained in a state which is spaced apart from both side walls of the second movable member 220 by the elastic member 214. That is, the elastic member 214 serves to enable the first movable member 110 and the second movable member 220 to be maintained in a state illustrated in FIG. 3, as long as the external force is not applied to the first movable member 210.

As another example, both of the side walls may not be provided at the second movable member 220. In this case, while the first movable member 210 is rotated, the first movable member 210 is in contact with a wall which forms the opening 113 of the casing 110, and thus rotation of the first movable member 210 may be restricted. At this point, the wall which forms the opening 113 serves as a rotation restricting part which restricts the rotation of the first movable member 210.

When the external force is applied to the first movable member 210, the first movable member 210 may be rotated about the hinge shaft 214, and when the external force applied to the first movable member 210 is released, the first movable member 210 is returned to its original position by the elastic member 214.

A driving device for driving the side brush 230 is provided inside the first movable member 210. The driving device may include a brush driving unit 241, and a power transmission unit which transmits power of the brush driving unit 241 to the side brush 230.

The brush driving unit 241 may be a motor. The power transmission unit may include a first pulley 242 which is connected to the brush driving unit 241, a second pulley 243 which is connected to the brush holder 233 of the side brush 230, and a belt which is wound on the first pulley 242 and the second pulley 243.

According to the embodiment, since the driving device is located inside the first movable member 210, and thus the driving device is movable together when the first movable member 210 is moved, an operating state of the driving device may be maintained, and the power may be stably provided to the side brush 230.

The above-described embodiment has described an example in which the driving device includes one pair of pulleys and the belt. However, unlike this, the driving device may include a plurality of gears, or may include a plurality pulleys and a plurality of belts.

Meanwhile, the automatic cleaner 10 may further include a control unit 150 which controls an entire operation of the automatic cleaner 10, and an obstacle sensor 160 which detects an obstacle. The control unit 150 may control the moving device or each of the driving units 122 and 240 based on information detected by the obstacle sensor 160.

Hereinafter, an operation of the side brush assembly according to the embodiment will be described.

Figure 4:
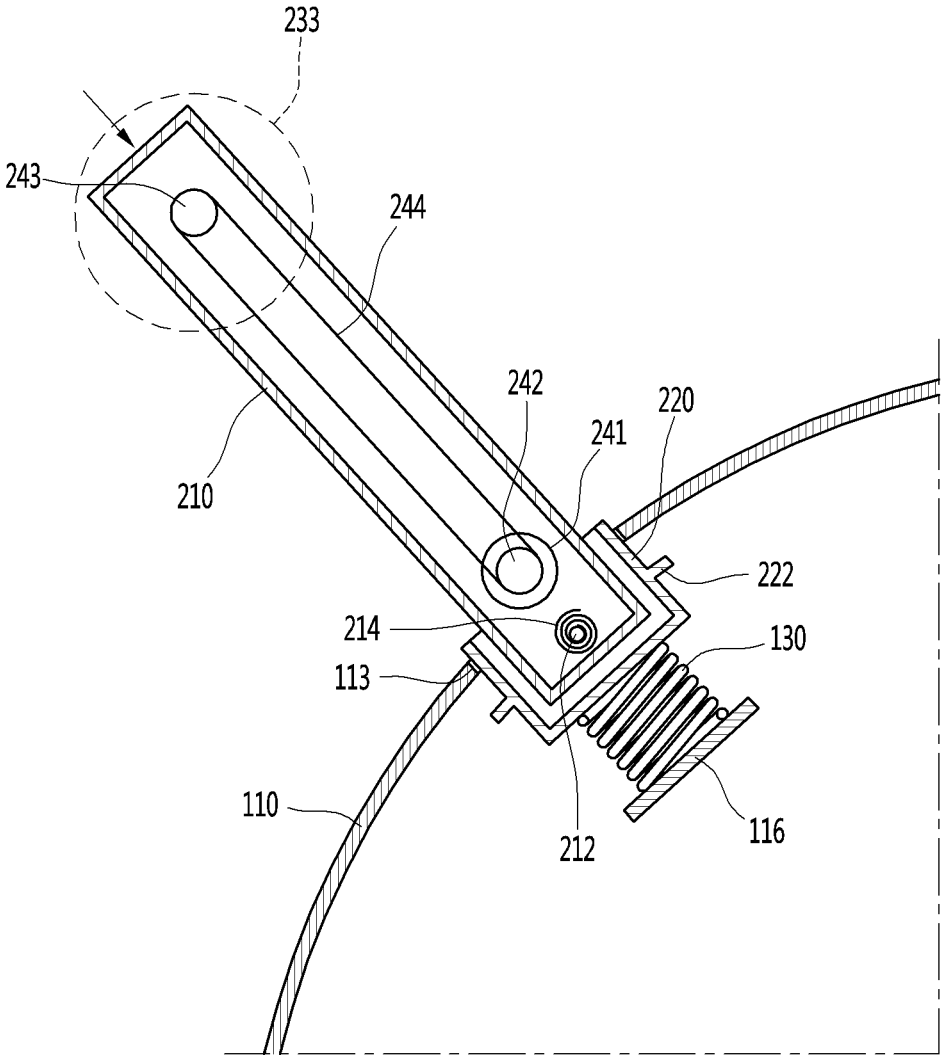
FIGS. 4 and 5 are views illustrating a state in which the side brush assembly according to the first embodiment is moved by an external force.
Figure 5:
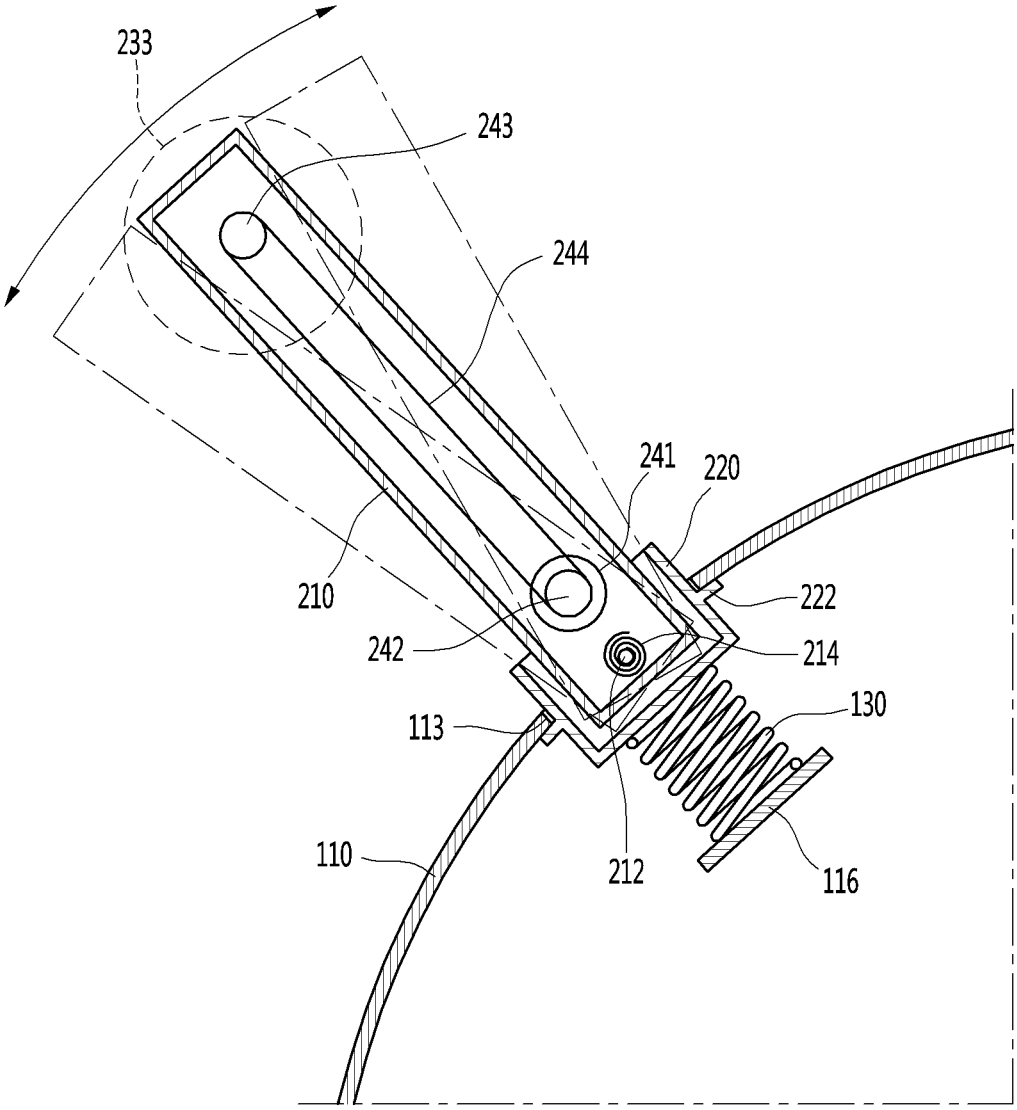

FIGS. 4 and 5 are views illustrating a state in which the side brush assembly according to the first embodiment is moved by the external force.

Referring to FIGS. 4 and 5, to clean a surface to be cleaned (e.g., a floor surface) using the automatic cleaner, the automatic cleaner is turned on. After the automatic cleaner is turned on, a cleaning operation may be performed by the main brush 120 while the automatic cleaner is moved through the moving device automatically or by inputting a start command.

The brush driving unit 241 is turned on at the same time when the automatic cleaner is turned on, and thus the side brush may be rotated. Alternatively, when the automatic cleaner detects a corner, the brush driving unit 241 may be turned on.

While the automatic cleaner is travelling, the side brush assembly is maintained in a protruding state to the outside of the casing, as illustrated in FIG. 2. In this state, the floor surface may be cleaned by rotation of the side brush 230.

Meanwhile, as illustrated in FIG. 4, when the external force indicated by an arrow is applied to the side brush assembly of the automatic cleaner, the external force is transmitted to the second movable member 220 through the first movable member 210. That is, when the external force is applied to the side brush assembly 200 in a direction toward the hinge shaft 214, the external force does not act as a rotating force of the first movable member 210, but acts as a moving force of the second movable member 220. Then, a part of the second movable member 220 is inserted into the casing 210, and thus the protruding length of the second movable member 220 to the outside of the casing 110 is reduced, and the elastic member 130 is contracted. Eventually, a shock applied to the side brush assembly may be absorbed by contraction of the elastic member 130. Therefore, in the embodiment, the second movable member 220 and the elastic member 130 serve as shock absorbing members.

Meanwhile, as illustrated in FIG. 5, when the external force is not applied in a direction toward the hinge shaft 214, the external force acts as the rotating force of the first movable member.

As described above, since the first movable member 210 is spaced apart from both of the side walls of the second movable member 220, the first movable member 210 may be rotated clockwise or counterclockwise as indicated by an arrow. And when the first movable member 210 is in contact with one of both of the side walls while being rotated, the rotation thereof is stopped. Accordingly, in the embodiment, both of the side walls of the second movable member 220 may be referred to as the rotation restricting parts which restrict a rotation angle range of the first movable member 210.

At this point, since the brush driving unit 241 is also rotated together when the first movable member 210 is rotated, power of the brush driving unit 241 may be transmitted to the side brush 230, regardless of the rotation of the first movable member 210.

According to the embodiment, since the first movable member 210 may be rotated by the external force, the first movable member 210 serves to absorb the shock, and also the cleanable area may expand because rotation of the side brush 230 is maintained even when the first movable member 210 is in a rotated state.

As another example, the first movable member and the second movable member may be integrally formed. In this case, the hinge shaft and the elastic member 214 may be omitted. Even in this case, the movable members 210 and 220 may be elastically supported by the elastic member 130 and may be slidable. And the movable members 210 and 220 may be rotatable within a range of the opening 113, as long as the opening 113 is formed to have a size larger than sizes of the movable members 210 and 220.

Figure 6:
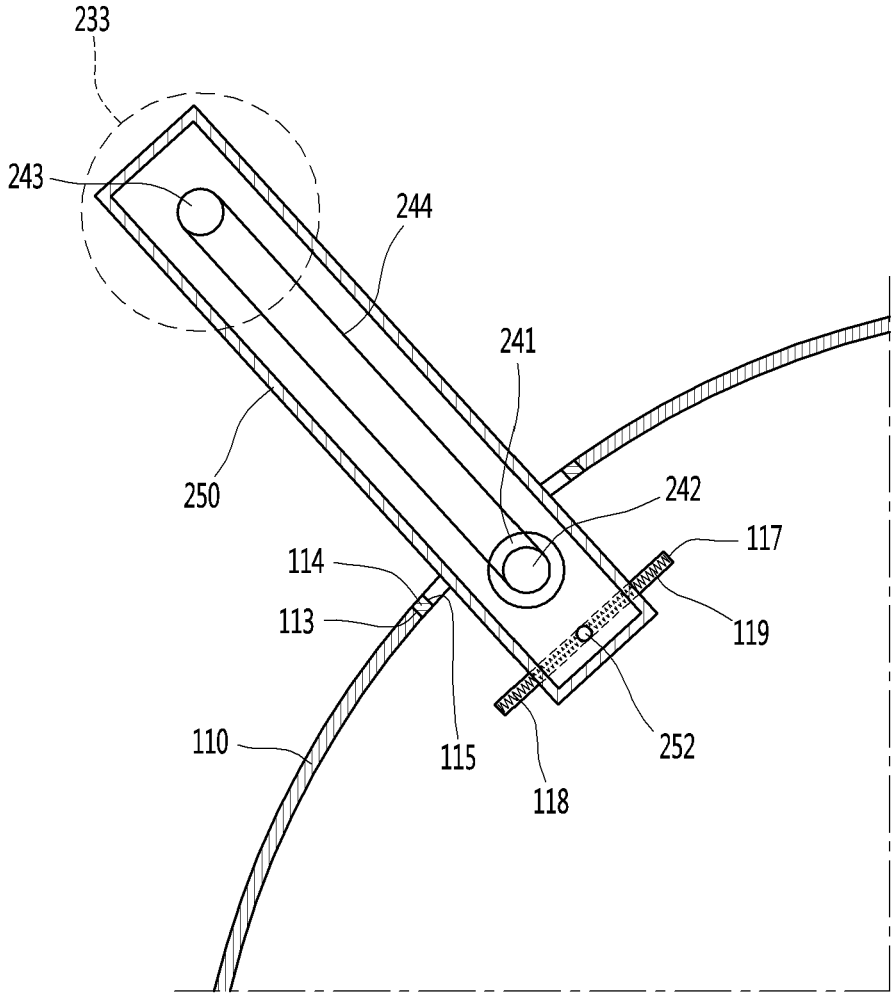
FIG. 6 is a cross-sectional view of a side brush assembly according to a second embodiment of the present invention.

FIG. 6 is a cross-sectional view of a side brush assembly according to a second embodiment of the present invention.

The second embodiment illustrated in FIG. 6 is the same as the first embodiment, except the movable member and a structure for absorbing the shock of the movable member. Therefore, hereinafter, only characteristic parts of the embodiment will be described.

Referring to FIG. 6, the side brush assembly may include a movable member 250 which is rotatably connected to the casing 110.

The movable member 250 may be rotatably connected to the casing 110 by a hinge shaft 252. Driving devices 241, 242, 243 and 244 for driving the side brush 230 may be provided inside the movable member 250.

An opening 113 through which the movable member 250 passes is formed at the casing 110. The movable member 250 may be rotated about the hinge shaft 252 by the external force. While the movable member 250 is rotated, the movable member 250 may collide with a surface which forms the opening 113. Therefore, in the embodiment, a shock absorbing member 114 which absorb a shock generated by a collision with the movable member 250 may be provided at the opening 113. The shock absorbing member 114 may be substantially formed in a ring shape, and may include a hole 115 through which the movable member 250 passes.

The hinge shaft 252 may be fixed to the casing 110 so as to be only rotatable, or may be slidably connected to the casing 110.

FIG. 6 illustrates an example in which the hinge shaft 252 is slidably connected to the casing 110.

A shaft guide part 252 which enables the hinge shaft 252 to be movable may be formed at the casing 110, and a part of the hinge shaft 252 is inserted into the shaft guide part 252. One or more elastic members 118 and 119 which elastically support the hinge shaft 252 may be provided at the shaft guide part 252. For example, one pair of elastic members 118 and 119 which support both sides of the hinge shaft 252 may be provided at the shaft guide part 252. That is, the hinge shaft 252 is located between the pair of elastic members 118 and 119.

Therefore, depending on a direction or an intensity of the external force, the movable member 250 may be rotated about the hinge shaft 252 while movement of the hinge shaft 252 is stopped, or may be rotated about the hinge shaft 252 while being moved together with the hinge shaft 252 which is being moved horizontally.

Figure 7:
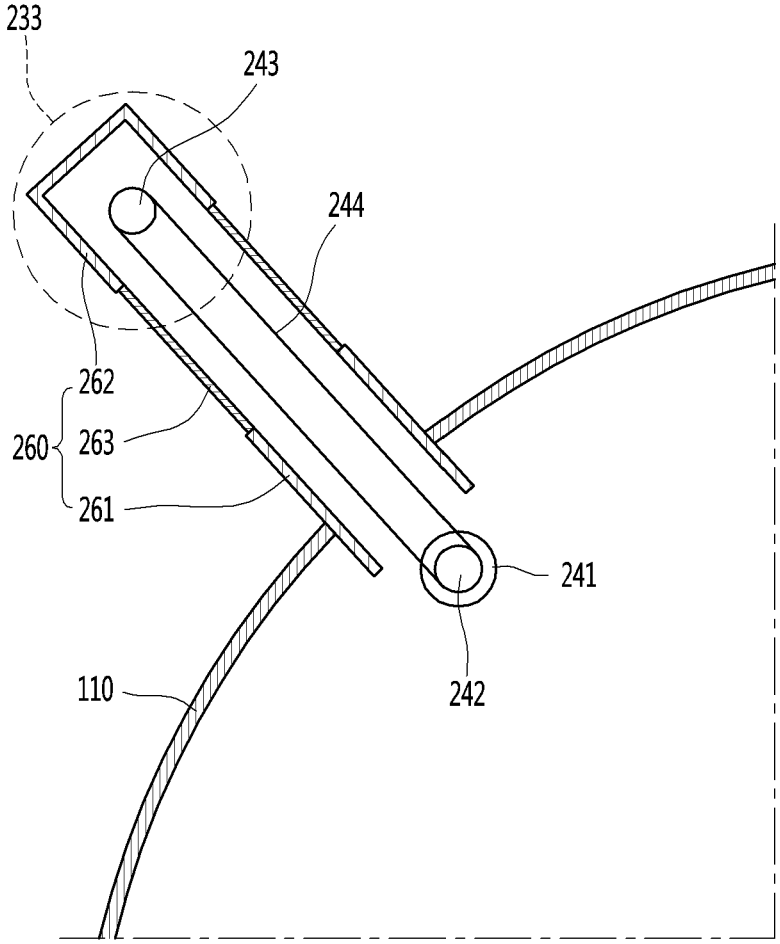
FIG. 7 is a cross-sectional view of a side brush assembly according to a third embodiment of the present invention.

FIG. 7 is a cross-sectional view of a side brush assembly according to a third embodiment of the present invention.

The third embodiment illustrated in FIG. 7 is the same as the first embodiment, except the movable member and a structure for absorbing the shock of the movable member. Therefore, hereinafter, only characteristic parts of the embodiment will be described.

Referring to FIG. 7, the side brush assembly may include a movable member 260 which protrudes from an outer side of the casing 110 and rotatably supports the side brush 230.

The movable member 260 of the embodiment may be formed so that a part thereof, instead of the whole thereof, is moved. Specifically, the movable member 260 may include a fixed member 261 which is a rigid body fixed to the casing 110, a connection member 263 which is formed of a flexible material and connected to the fixed member 261, and a supporting member 262 which is a rigid body connected to the connection member 263. The side brush 230 may be supported by the supporting member 262.

The brush driving unit 241 may be installed at the casing 110. The first pulley 242 may be connected to the brush driving unit 241, and the second pulley 243 may be installed at the supporting member 262, and the belt 244 may pass through the connection member 263.

Therefore, according to the embodiment, a part of the movable member 261 may be moved by the connection member 263.

However, in the embodiment, the connection member 263 may be formed to be deformed when a predetermined intensity of force or more is applied, but may need rigidity enough not to be bent by its own weight of the side brush 230.

As another example, the brush driving unit 241 may be installed at the fixed member 261. Alternatively, the brush driving unit 241 may be installed at the supporting member 261. In this case, the brush driving unit 241 may be directly connected to the side brush 230.

As still another example, the fixed member may be omitted, and the connection member may be connected to the casing.

Alternatively, the movable member may include a plurality of links formed in a tunnel shape which is rotatable about a vertical axis, and the side brush may be installed at an outmost link among the plurality of links. However, in this case, a belt may be provided inside each link so that the power is smoothly transmitted when the plurality of links are relatively rotated, and thus the power of the brush driving unit may be transmitted to a plurality of belts in stages. Alternatively, a brush driving member may be provided at the outmost link.

Even though all the elements of the embodiments are coupled into one or operated in the combined state, the present disclosure is not limited to such an embodiment. That is, all the elements may be selectively combined with each other without departing from the scope of the invention. Furthermore, when it is described that one comprises (or includes or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in a descriptive sense only and not for purposes of limitation, and also the technical scope of the invention is not limited to the embodiments. Furthermore, the present invention is defined not by the detailed description of the invention but by the appended claims, and all differences within the scope will be construed as being comprised in the present disclosure.

The invention claimed is:

1. An automatic cleaner comprising:

a casing having an inlet port;

a suction device installed inside the casing and configured to suction external foreign substances through the inlet port;

a moving device configured to move the casing; and a side brush assembly movably installed at the casing, wherein the side brush assembly includes:

a frame moveably connected to the casing, wherein a portion of the frame is provided within the casing, and another portion of the frame is provided outside the casing, an extension pivotably connected to the frame via a hinge shaft, wherein the extension protrudes from the casing, a side brush rotatably provided on the extension, a driving device provided in the extension to drive the side brush, wherein the extension and the driving device pivot relative to the hinge shaft, and a first elastic member provided in the casing, wherein the first elastic member elastically supports the frame to allow movement of the frame, couples the frame to the casing, and is configured to be compressed such that the extension and the frame are inserted into the casing when an external force is applied to the extension in a direction toward the hinge shaft.

2. The automatic cleaner of claim 1, wherein the driving device comprises a brush driving unit, and a power transmission unit which transmits power of the brush driving unit to the side brush.

3. The automatic cleaner of claim 1, wherein a part of the frame restricts a pivot angle range of the extension as it pivots around the hinge shaft.

4. The automatic cleaner of claim 1, wherein the extension and the driving device pivot in a direction parallel to the floor surface.

5. The automatic cleaner of claim 1, wherein the frame includes at least one stopper that restricts a length of the frame that protrudes from the casing.

6. The automatic cleaner of claim 1, wherein the frame includes at least one stopper that restricts a range of motion of the frame from the inside to the outside of the casing.

7. The automatic cleaner of claim 6, wherein the first elastic member restricts the range of motion of the frame from the outside of the casing to the inside of the casing.

8. The automatic cleaner of claim 1, further including a second elastic member having a first end connected to the frame and a second end connected to the extension.

9. The automatic cleaner of claim 8, wherein the second elastic member is configured to maintain the extension in a non-contact state with the frame when no external force is applied to the extension.

10. The automatic cleaner of claim 1, wherein the extension is configured to pivot about the hinge shaft when an external force is applied to the extension in a lateral direction not directly toward the hinge shaft.

11. The automatic cleaner of claim 1, wherein the frame is slidably connected to the casing.

12. The automatic cleaner of claim 1, wherein the frame moves radially inward and outward from a center of the casing.

13. The automatic cleaner of claim 1, further including an obstacle sensor and a controller.

14. An automatic cleaner comprising:

a casing coupled to a motor driven wheel, the motor driven wheel configured to move the casing in a prescribed direction, a suction device installed inside the casing and configured to suction external foreign substances through an inlet of the casing, a frame moveably connected to the casing, wherein a first portion of the frame is provided in the casing, and a second portion of the frame is provided outside the casing, an extension coupled to the frame via a hinge shaft inside the first portion of the frame and protruding beyond the second portion of the frame, a rotating brush provided on the extension, and an elastic member holding the frame inside the casing.

15. The automatic cleaner of claim 14, wherein the frame is slidably connected to the casing, and wherein the elastic member is configured to expand and compress in a direction in which the frame slidably moves.

16. The automatic cleaner of claim 14, wherein a brush drive unit is provided in the extension.

17. An automatic cleaner comprising:

a casing coupled to a motor-drive wheel, the motor driven wheel configured to move the casing in a prescribed direction, a suction device installed inside the casing and configured to suction external foreign substances through an inlet of the casing, a frame moveably connected to the casing via an elastic member, wherein a first portion of the frame is provided in the casing, and a second portion of the frame is provided outside the casing, an extension coupled to the frame via a hinge shaft, at least one side brush assembly, the side brush assembly including:

a brush provided on the extension, and a motor configured to rotate the brush and provided inside the extension, wherein the extension and the motor pivot relative to the hinge shaft.

* * * * *